US012274923B2

(12) United States Patent
Poltimäe

(10) Patent No.: US 12,274,923 B2
(45) Date of Patent: Apr. 15, 2025

(54) QUICK RELEASE CONNECTION FOR JUMP ROPE

(71) Applicant: Bodyhackerz OÜ, Harju maakond (EE)

(72) Inventor: Martin Poltimäe, Harju maakond (EE)

(73) Assignee: Bodyhackerz OÜ, Tallinn (EE)

( * ) Notice: Subject to any disclaimer, the term of this patent is extended or adjusted under 35 U.S.C. 154(b) by 184 days.

(21) Appl. No.: 18/159,965

(22) Filed: Jan. 26, 2023

(65) Prior Publication Data

US 2023/0249021 A1 Aug. 10, 2023

(30) Foreign Application Priority Data

Feb. 9, 2022 (EP) ..... 22020045

(51) Int. Cl.
*A63B 5/20* (2006.01)
*A63B 21/00* (2006.01)

(52) U.S. Cl.
CPC ..... *A63B 5/20* (2013.01); *A63B 21/00061* (2013.01)

(58) Field of Classification Search
None
See application file for complete search history.

(56) References Cited

U.S. PATENT DOCUMENTS 3,017,678 A * 1/1962 Christensen ..... F16G 11/101 24/134 R
4,541,149 A * 9/1985 Jensen ..... B63B 21/08 24/132 R
4,878,270 A * 11/1989 Westerkamp ..... F16G 11/04 24/132 R
5,064,235 A * 11/1991 Lessard ..... F16G 11/10 294/82.14
5,454,140 A * 10/1995 Murai ..... F16G 11/106 24/136 R (Continued)

FOREIGN PATENT DOCUMENTS

CN 108853873 A * 11/2018
CN 109999403 A * 7/2019 ..... A63B 5/20

(Continued)

OTHER PUBLICATIONS

Extended European search report in regards with corresponding European application EP220200452; dated on Jul. 20, 2022; 5 pages.

*Primary Examiner* — Shila Jalalzadeh Abyaneh
(74) *Attorney, Agent, or Firm* — Koivula & Somersalo, LLC

(57) ABSTRACT

Quick release connection for jump rope facilitating exchanging of cables with different weights and diameters on jump rope handles. The quick release connection for jump rope comprises the housing of quick release connection with a locking part attached. The locking part comprises a toothed pawl loaded with a spring engaging with the teeth of the linear rack attached to the cable adapter. The housing of the quick release connection has protruding first and second sidewalls, defining a holding channel including at least one guide rail, for receiving the cable adapter. The linear rack has at least one protruding part that is configured to move into at least one guide rail featured on at least one of the sidewalls of the holding channel. The possible insertion of the cable adapter into the holding channel is only in the longitudinal, reciprocating position.

6 Claims, 7 Drawing Sheets

(56) References Cited

U.S. PATENT DOCUMENTS

| | | | | | |
|---|---|---|---|---|---|
| 5,947,629 | A * | 9/1999 | Anscher | F16G 11/101 | 403/374.5 |
| 6,092,561 | A * | 7/2000 | Schmid | D03D 47/23 | 139/196.2 |
| 6,505,384 | B1 * | 1/2003 | Renton | F16G 11/106 | 24/132 WL |
| 7,293,438 | B2 * | 11/2007 | Benda | F16G 11/106 | 70/49 |
| 8,321,998 | B2 * | 12/2012 | Warren | F16G 11/14 | 403/301 |
| 8,684,892 | B1 * | 4/2014 | Ihli | A63B 5/20 | 482/81 |
| 8,911,333 | B2 | 12/2014 | Hunt | | |
| 9,746,131 | B2 * | 8/2017 | Hall | G03B 17/566 | |
| 10,376,728 | B2 | 8/2019 | Newman | | |
| 10,478,655 | B2 | 11/2019 | Hunt | | |
| 11,607,573 | B2 * | 3/2023 | Hunt | A63B 5/20 | |
| 12,044,040 | B2 * | 7/2024 | Enger | E05B 67/003 | |
| 2006/0128534 | A1 * | 6/2006 | Roque | A63B 15/00 | 482/109 |
| 2019/0118019 | A1 * | 4/2019 | Hunt | A63B 5/20 | |
| 2020/0030653 | A1 | 1/2020 | Hunt | | |

FOREIGN PATENT DOCUMENTS

| | | | |
|---|---|---|---|
| KR | 20060030936 | A * | 4/2006 |
| WO | WO-2021097959 | A1 * | 5/2021 |

* cited by examiner

QUICK RELEASE CONNECTION FOR JUMP ROPE

TECHNICAL FIELD

The invention belongs among technical equipment for physical training, specifically the invention concerns a quick release connection for jump rope.

PRIOR ART

A removable connection/fastener for jump rope is known (US2020030653, Crossrope LLC, published Jan. 30, 2020). The jump rope comprises a handle and a wire rope. The handle comprises a handle grip and the first connection element. The wire rope comprises the second connection element. The first and second connection elements are configured to removably connect the cable to the handle. The connection/fastening for jump rope has a male connection element and a female connection element. The male connection element comprises a front part with at least one lockable protrusion. The female connection element determines the opening, which has been configured so that at least a part of the male connection element is received in the inner cavity of the female connection element. The female connection element comprises at least one locking lever, and at least one locking lever is in one tilted position, and at least one locking lever is configured to move from that one position into another position when the male connection element has been inserted in the opening of the female connection element. At least one locking lever of the female connection element is configured to return to the first position as a result of insertion of the male connection element, in order to create a secure connection between the male and female connection elements. A shortcoming of the connection/fastening described is the fact that in order to open the quick release connection, the user must simultaneously press on two points, otherwise the fastener does not open.

SUMMARY OF THE INVENTION

The goal of the invention is to produce a quick release connection for jump rope facilitating easy and quick exchange of ropes/cables with different weights and diameters on jump rope handles to change the intensity of trainings with the help of ropes/cables with different weights.

The quick release connection for jump rope presented here comprises the housing of quick release connection with protruding sidewalls, which are interconnected from above with a connecting part and where at least one sidewall has a longitudinal guide rail. The housing of quick release connection comprises a recess for the locking part and means for attachment of the locking part. The locking part comprises a spring loaded toothed pawl which engages to the teeth of the linear rack, whereas the teeth of the linear rack and toothed pawl are asymmetrical and have a trapezoidal profile, and the first and the last legs are at different angles to the straight line perpendicular to the bases. The cable adapter comprises a linear rack with at least two teeth, with a protruding part on at least one side, which is configured to move into the guide rail attached to at least one sidewall of the housing of the quick release connection, and the sidewalls determine a holding channel, which is configured to receive the cable adapter. The sidewalls are configured at an angle to prevent the cable adapter from falling/moving out from the sidewalls. It is only possible to insert the cable adapter into the holding channel determined by the sidewalls longitudinally, in back-and-forth position, and the cable adapter comprises a socket for insertion of cable and means for locking the cable.

LIST OF FIGURES

Figure 1:
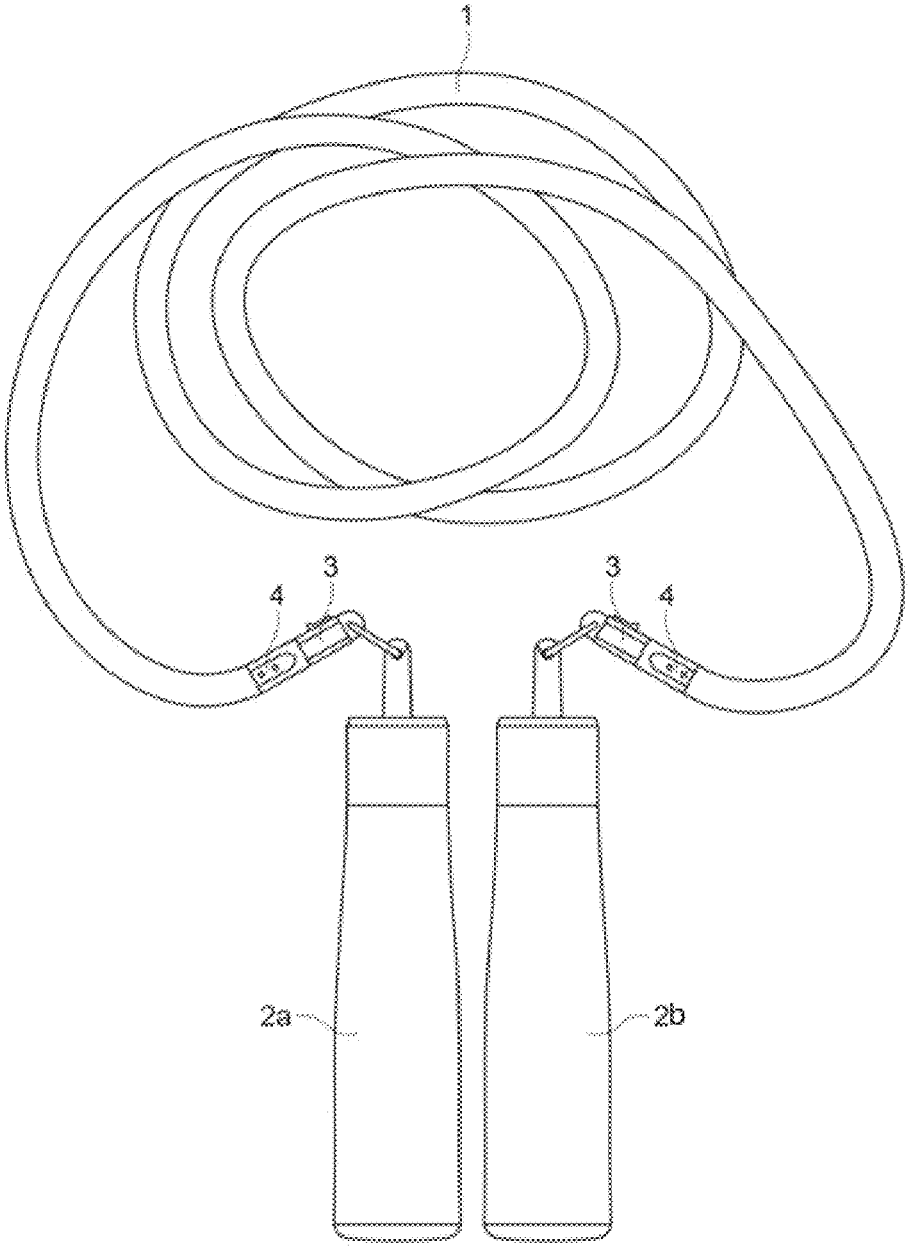
FIG. 1 shows a jump rope with quick release connections and handles.
Figure 2:
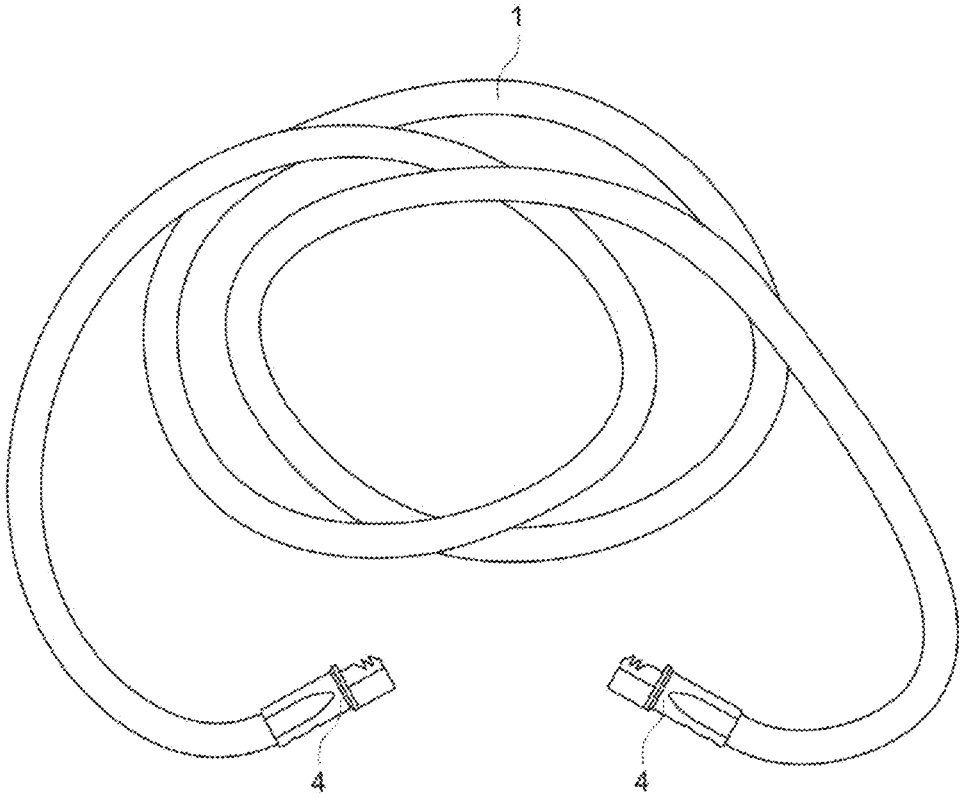
FIG. 2 shows a jump rope with a cable adapter compatible with the housing of the quick release connection.
Figure 3:
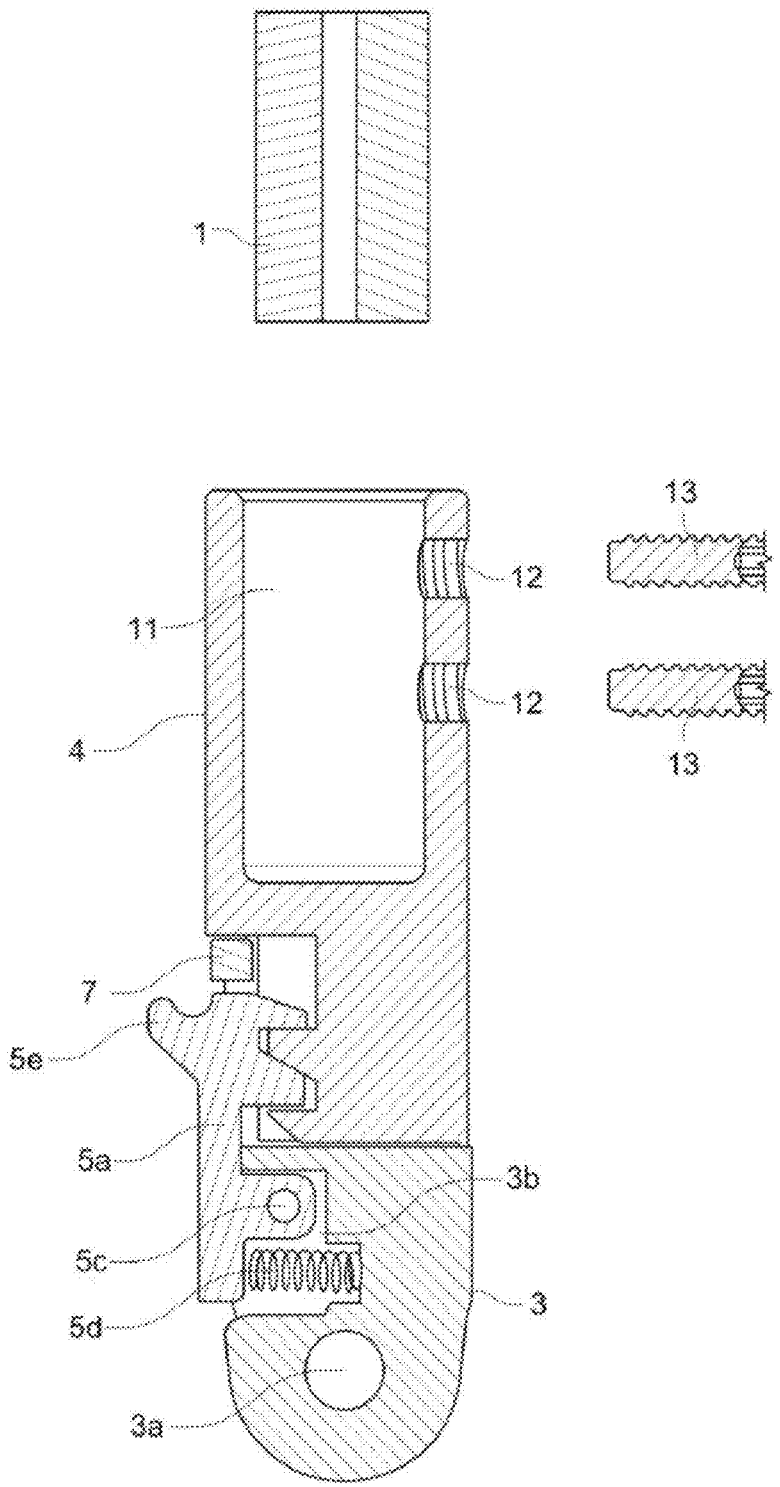
FIG. 3 shows a cross-section of the quick release connection in locked/connected position.
Figure 4A:
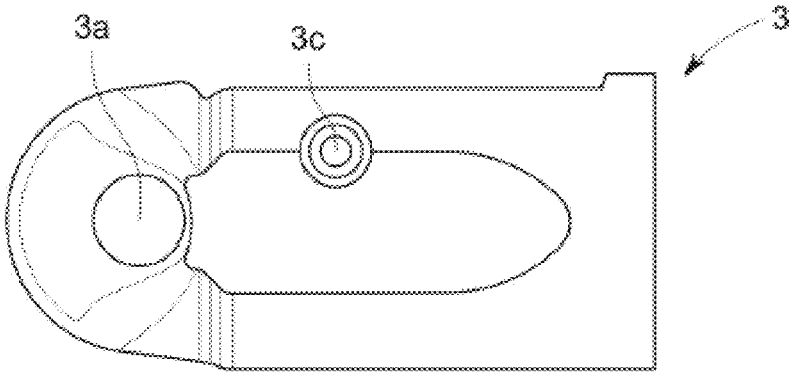
Figure 4B:
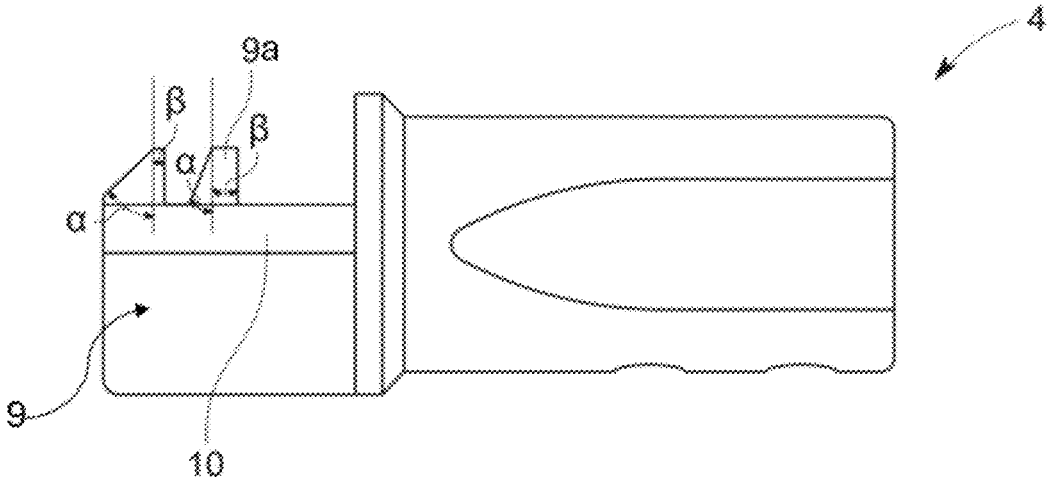
Figure 4C:
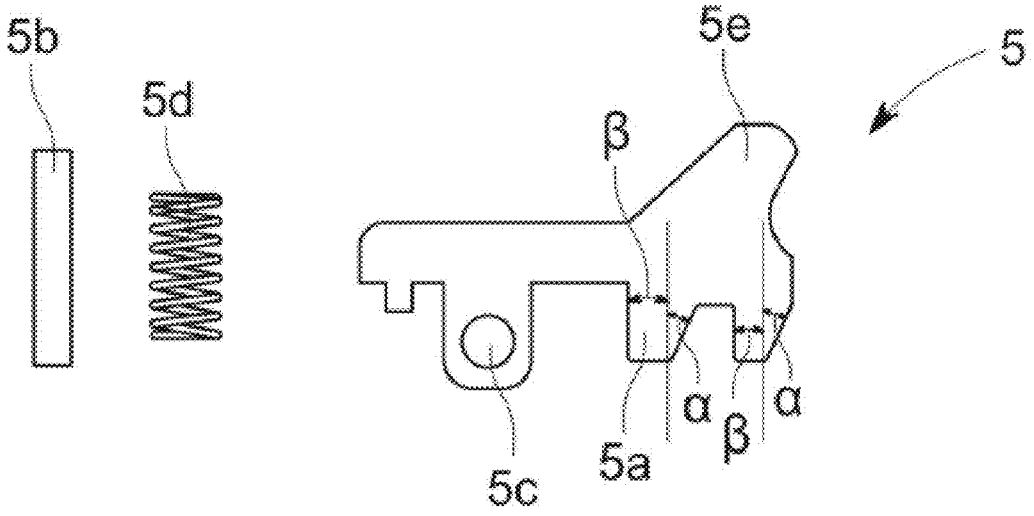

FIGS. 4A-C show a detailed view of the quick release connection (FIG. 3). FIG. 4A depicts the housing of the quick release connection, FIG. 4B shows a cable adapter compatible with the housing of the quick release connection, FIG. 4C shows additional components of the quick release connection.

Figure 5:
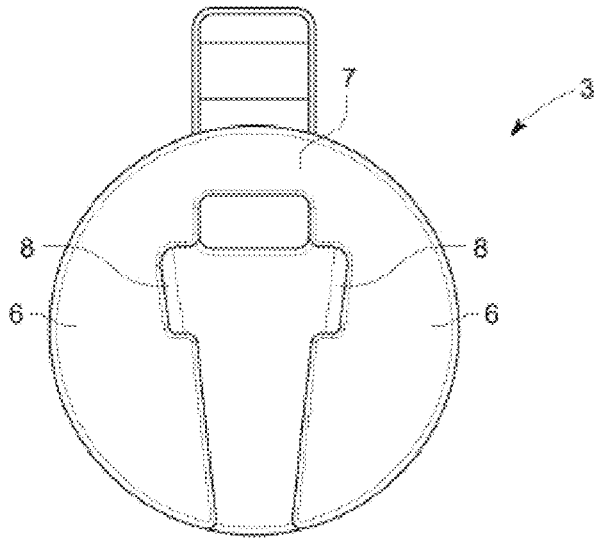

FIG. 5 provides an end view of the quick release connection.

Figure 6:
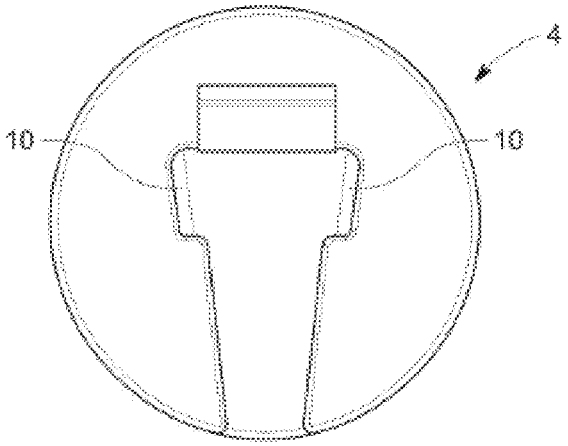

FIG. 6 provides an end view of the cable adapter compatible with the housing of the quick release connection.

Figure 7:
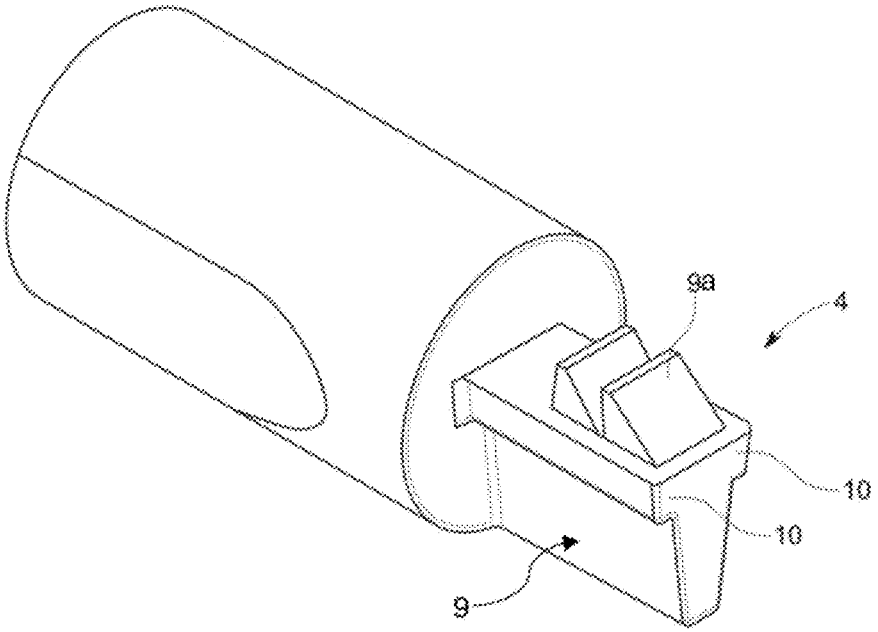

FIG. 7 gives a perspective view of the cable adapter.

Figure 8:
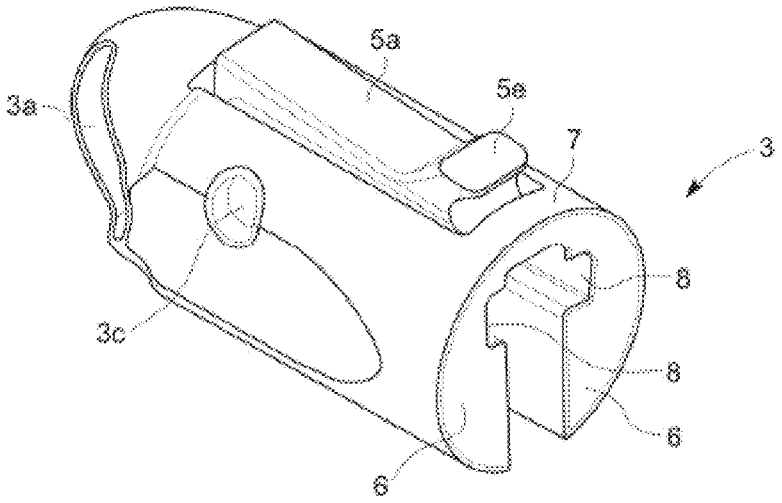

FIG. 8 gives a perspective view of the housing and locking part of the quick release connection.

Figure 9:
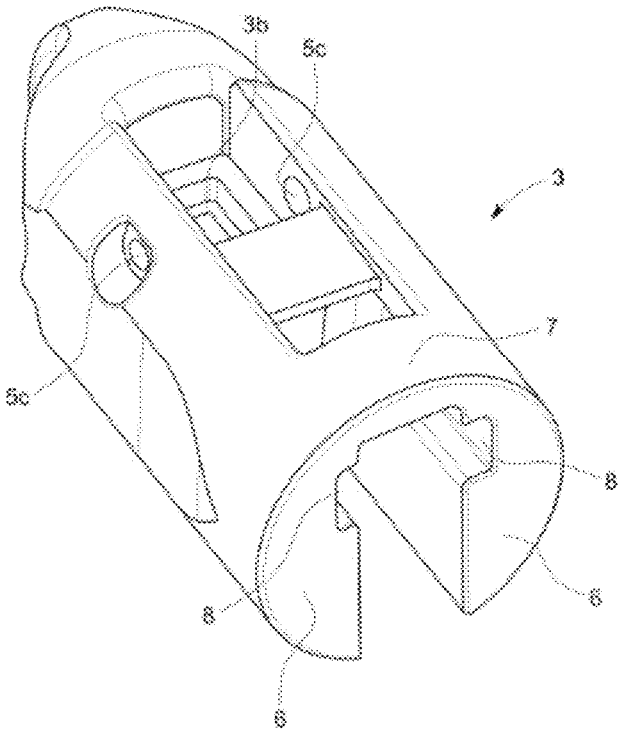

FIG. 9 gives a perspective view of the housing of the quick release connection without the locking part.

EMBODIMENT OF THE INVENTION

The presented quick release connection for jump rope comprises a jump rope 1 and handles 2*a*, 2*b* and, for attachment of the jump rope to the handles, a quick release connection comprising the housing of the quick release connection 3 and a compatible cable adapter 4. Housing of the quick release connection 3 comprises an opening 3*a* for connecting the housing 3 with handle 2*a*, 2*b*, a recess 3*b* containing a locking part 5, an opening 3*c* for attachment of pin 5*b* of locking part 5. Locking part 5 comprises a spring 5*d* loaded toothed pawl 5*a* with pulling part 5*e* attached to it, pin 5*b* for attachment of toothed pawl 5*a* to the housing of the quick release connection 3, and an opening 5*c* for mounting pin 5*b*. The housing of quick release connection 3 also comprises two sidewalls 6, which are interconnected from above with a connecting part 7, whereas at least one sidewall 6 having a longitudinal guide rail 8. Guide rails 8 may also be present on both sidewalls 6. Cable adapter 4 comprises a linear rack 9, with at least one protruding part 10. Cable adapter 4 comprises a socket 11 for insertion of cable 1 and at least one screw hole 12 and screw 13 for locking cable 1.

The housing of quick release connection 3 has protruding first and second sidewalls 6, which are interconnected from above with a connecting part 7. The sidewalls 6 determine the holding channel, which is configured to receive the cable adapter 4, whereas the sidewalls 6 are configured at an angle to prevent the cable adapter 4 from falling/moving out from the sidewalls 6. Toothed pawl 5*a* with spring 5*d* is designed for locking the linear rack 9 attached to cable adapter 4.

Cable adapter 4 of the quick release connection comprises a linear rack with at least two teeth 9*a*, with a protruding part 10 on at least one side or on both sides, configured for mechanical insertion between the sidewalls 6 of the housing of the quick release connection 3 and the guide rail(s) 8 attached to those. Due to the at least one protruding part 10 of the cable adapter 4 of the quick release connection, it stays in a secure position when connected between the sidewalls 6 and cannot move up, down, to left or right around its axis. Cable adapter 4 of the quick release connection can move in the holding channel determined by the sidewalls 6 attached to the housing of the quick release connection 3 only longitudinally back and forth.

The teeth of the toothed pawl 5*a* engages the teeth of the linear rack 9. The linear rack 9 and the toothed pawl 5*a* have interlocking teeth and each of their teeth is asymmetrical and has a trapezoidal profile, where the legs of the trapezoid are two surfaces where the front leg is at angle α to the straight line perpendicular to the bases, and the back leg is at angle β to the straight line perpendicular to the bases, whereas the angles α and β of each tooth may be different: angle α is 10 to 80 degrees and angle β is −45 to +45 degrees.

Locking of the quick release connection happens when the cable adapter 4 is inserted into the holding channel determined by the sidewalls 6 protruding from the housing of the quick release connection 3, causing the toothed pawl 5*a* loaded with a spring 5*d* to catch the linear rack 9 attached to the cable adapter 4. When the interlocking teeth move towards the locked position (forward), the toothed pawl 5*a* easily slides up over the edges of the teeth with a smaller angle (α), where the spring 5*d* forces it between the teeth after each tooth end passed. When the teeth move to the opposite direction (backwards), the toothed pawl 5*a* catches the steeper sloped edge (β) of the teeth encountered, thus locking against the teeth and preventing further movement in that direction. The deeper the cable adapter 4 of the quick release connection is pushed into the holding channel between sidewalls 6, the more teeth of the toothed pawl 5*a* are locked against the teeth of the linear rack 9 to achieve a secure locking, while a sufficiently secure locking is already achieved by locking the first tooth. Full locking is achieved when the first tooth of the toothed pawl 5*a* slides over the last tooth of the linear rack 9.

To open the quick release connection, the user shall pull up the pulling part 5*e* located on the toothed pawl 5*a*, resulting in a possibility to remove the cable adapter 4 with linear rack 9 from the holding channel determined by the sidewalls 6 of the housing of the quick release connection 3.

The main advantage of the disclosed quick release connection is that it is possible to open the quick release connection quickly by simply pulling up the pulling part 5*e* of the toothed pawl 5*a* by just one finger.

Another advantage of the presented solution is that the usability of the locking and the device is ensured even if the user has not fully inserted the cable adapter 4 into the housing of the quick release connection 3 (e.g. the first tooth of the toothed pawl 5*a* has reached beyond the first tooth of linear rack 9). In case of full locking, if the user touches the pulling part 5*e* of the pawl while using the device, the toothed pawl 5*a* may move back to a preceding tooth of linear rack 9, which still maintains a sufficiently secure attachment of the quick release connection.

The disclosed quick release connection enables the user to insert different cable adapters 4 with the properties of cable 1 into the housing of the quick release connection 3, so that the user can conveniently use a pre-configured training device with suitable weight level, using cables with different length and weight.

The user may also replace the cable in socket 11 of the cable adapter 4 with a cable of suitable length. For that, the screw(s) 13 shall be removed from the opening(s) 12 of the cable adapter 4, and the cable shall be cut to the length suitable for optimum use to achieve the best possible comfort of use. The user can also replace cable 1 with a new identical cable 1 when it becomes worn.

LIST OF MARKINGS

1—cable;
2*a* and 2*b*—handles;
3—housing of the quick release connection;
3*a*—opening for connecting the housing 3 with handle 2*a*, 2*b;*
3*b*—recess where the locking part 5 is placed;
3*c*—opening for attaching pin 5*b;*
4—cable adapter;
5—locking part;
5*a*—toothed pawl;
5*b*—pin for attachment of toothed pawl 5*a;*
5*c*—opening for pin 5*b;*
5*d*—spring;
5*e*—pulling part of the grip;
6—sidewall;
7—connecting part of sidewalls;
8—guide rail(s);
9—linear rack;
10—protruding part on the side of the linear rack 9;
11—socket for attachment of cable 1 to the adapter 4 of the quick release connection;
12—screw hole for locking cable 1;
13—screw for locking cable 1 to socket 11.

The invention claimed is:

1. A quick release connection for jump rope comprising: a housing, a cable adapter, connecting parts and a locking part comprising a spring, a pin and a toothed pawl with an opening for the pin, wherein:

the housing comprises a first sidewall and a second sidewall, which are interconnected from above with a connecting part, at least one of the first sidewall and the second sidewall has a longitudinal guide rail, and the housing further comprises a recess for the locking part, the cable adapter comprises a linear rack with at least two teeth, and a protruding part on at least one side of the linear rack, the toothed pawl comprises at least two teeth which are configured to engage the at least two teeth of the linear rack, each of the at least two teeth of the linear rack and the at least two teeth of the toothed pawl is asymmetrical and has a trapezoidal profile, where legs of the trapezoid are two surfaces where a front leg is at an angle α to a straight line perpendicular to bases of the trapezoid, and a back leg is at angle β to the straight line perpendicular to the bases, and wherein the angles α and β of each tooth are different, and the angle α is between 10 to 80 degrees and the angle β is between −45 to +45 degrees, and the first sidewall and the second sidewall define a channel, configured to receive the linear rack of the cable adapter, wherein the linear rack of the cable adapter is configured to move only longitudinally back and forth in the channel.

2. The quick release connection for jump rope according to claim 1, wherein the cable adapter further comprises a socket for insertion of a cable.

3. The quick release connection for jump rope according to claim 2, wherein the cable adapter further comprises at least one screw hole and at least one screw for locking the cable in the socket.

4. The quick release connection for jump rope according to claim 1, wherein each of the first sidewall and the second sidewall has a longitudinal guide rail.

5. The quick release connection for jump rope according to claim 4, wherein the protruding part on the at least one side of the linear rack is configured to move into the longitudinal guide rail of the first sidewall or the second sidewall.

6. The quick release connection for jump rope according to claim 1, wherein the first sidewall and the second sidewall are configured at an angle to prevent the linear rack of the cable adapter inserted into the channel from falling/moving out.

* * * * *